US011806304B1

(12) United States Patent
Turner

(10) Patent No.: US 11,806,304 B1
(45) Date of Patent: Nov. 7, 2023

(54) WALKER LOCKING MECHANISM

(71) Applicant: Keith Turner, Knoxville, TN (US)

(72) Inventor: Keith Turner, Knoxville, TN (US)

( * ) Notice: Subject to any disclaimer, the term of this patent is extended or adjusted under 35 U.S.C. 154(b) by 0 days.

(21) Appl. No.: 18/351,534

(22) Filed: Jul. 13, 2023

Related U.S. Application Data

(60) Provisional application No. 63/408,582, filed on Sep. 21, 2022.

(51) Int. Cl.
*A61H 3/04* (2006.01)

(52) U.S. Cl.
CPC ..... *A61H 3/04* (2013.01); *A61H 2201/0161* (2013.01)

(58) Field of Classification Search
CPC .. F16B 7/0433; A61H 3/04; A61H 2201/0161
USPC ..... 248/513, 229.25, 229.15
See application file for complete search history.

(56) References Cited

U.S. PATENT DOCUMENTS 6,837,503 B2 * 1/2005 Chen ..... A61H 3/04 280/47.4
7,162,836 B2 * 1/2007 Van Straaten ..... F16B 7/0433 52/584.1
7,306,246 B2 * 12/2007 Gale ..... A61H 3/04 280/647
8,708,363 B1 * 4/2014 Chang ..... A61H 3/04 280/647
10,292,893 B2 * 5/2019 VanAusdall ..... B62B 5/0438
2011/0030749 A1 * 2/2011 Miller ..... A61H 3/04 135/67
2011/0140394 A1 * 6/2011 Willis ..... A61H 3/04 280/639

FOREIGN PATENT DOCUMENTS

WO WO-2014115085 A1 * 7/2014 ..... A61H 3/0244

* cited by examiner

*Primary Examiner* — Noah Chandler Hawk
(74) *Attorney, Agent, or Firm* — Pitts and Lake P.C.

(57) ABSTRACT

A rollator walker assembly with locking mechanism includes a walker including a pair of front legs and a pair of back legs, each said front leg and back leg having an upper end and a lower end, the walker being switchable between an unfolded position and a folded position; and a locking mechanism adapted to secure a front leg and a back leg when the walker is in the folded position, wherein the locking mechanism is connected to the front leg at a position closer to the front leg's lower end than the front leg's upper end, and wherein the locking mechanism is connected to the back leg at a position closer to the back leg's lower end than the back leg's upper end.

2 Claims, 4 Drawing Sheets

WALKER LOCKING MECHANISM

CROSS-REFERENCE TO RELATED APPLICATIONS

This application claims the benefit of the filing date of U.S. Provisional Patent Application Ser. No. 63/408,582, filed Sep. 21, 2022, the entire content of which is incorporated herein by reference.

STATEMENT REGARDING FEDERALLY SPONSORED RESEARCH OR DEVELOPMENT

Not Applicable

BACKGROUND OF THE INVENTION

Field of Invention

The present invention pertains generally to rollator walkers and, more particularly, to mechanisms for keeping a folding walker in a folded position during handling and transportation.

Description of the Related Art

A number of folding walkers with various means of folding the walker and attempting to keep the walker in a folded state are known in the art.

For example, U.S. Pat. No. 6,311,708, issued to Howle, discloses a walker having a frame which provides two front legs. Two rear legs are attached to the frame. A cross member provides support for the device which is supplemented by a link. Each of these structural members is in a pivotal relationship with the remaining members so the walker may be folded for storage. The cross member and link provide bracing for structural integrity, but are also incorporated into the folding structure. The optional seat is also in a pivotal relationship with the device. The seat prevents the walker from being folded while it is being used as a walker.

U.S. Pat. No. 6,338,493, issued to Wohlgemuth and De Winter, discloses an apparatus that is convertible between walker and a wheelchair has one pair of wheels that are continually engaged with the ground and a second pair of wheels that are movable from a first position out of engagement or disengaged with the ground, in which the apparatus is used as a walker, to a second position into engagement with the ground, in which the apparatus is used as a wheelchair. The movable wheels are controllable by the operator through the use of handle members connected such wheels. The handle members rotate the wheels into and out of engagement with the ground along a path that is at an angle from the vertical, thereby assuring disengagement of the wheels from the ground.

U.S. Pat. No. 6,378,883, issued to Epstein, discloses a motorized walker/wheelchair having wheels, an A-frame which has a driven a leg and a rolling leg which join at a vertex. Rising from one of the legs there is a control handle assembly. A motor wheel, or optionally two motor wheels, are provided at the lower portion of the driven leg of the A-frame. A caster wheel extends from the bottom of the rolling leg. Provision is made for a seat which is secured at its rearward portion to the seat support spreader. Hand controls are provided to the handle support which in turn control the operation of at least one motor driven wheel, or optionally, to separate motors driving two wheels. The two legs, the driven leg and a rolling leg, are joined at a pivot point at their vertex. Beneath the pivot point is a leg bridge which folds, thereby permitting the bridge beam to be raised upwardly which subsequently permits the driver wheel-caster arrangement to move in close proximity to each other while the seat folds upwardly and the entire unit transfers itself into the portable or folded mode.

U.S. Pat. No. 8,511,694, issued to Bradshaw and Linde, discloses a reversible walker assembly that is reconfigurable to provide seating in either the forward-facing, or the rear-facing direction. The disclosed reversible walker assembly includes a foldable, wheeled frame assembly, a seat mounted to the frame, and a reversible cross-arm, or backrest, for reconfiguring the apparatus from a rear-facing seating arrangement to a forward-facing seating arrangement. In a further aspect, hinged arms, one on each side of the frame assembly, are operable to at least partially rotate in a plane adjacent to the plane of the frame to which it is attached, thereby offering alternative positions of the arms that are convenient to the forward-facing seating position and the rear-facing seating position.

U.S. Pat. Nos. 8,967,642 and 9,414,987, both issued to Bagheri, disclose apparatus having an upper frame adapted to at least partially encircle a person; a lower frame; a scissor mechanism for coupling the upper frame to the lower frame, wherein the distance between the upper frame and the lower frame can be varied by adjusting the scissor mechanism; and a telescoping rod coupled to the scissor mechanism for locking the scissor mechanism, wherein the distance between the upper frame and the lower frame is locked by the telescoping rod.

U.S. Patent Application Publication Number 2005/0211285, by Cowie and Hallgrimsson, discloses a mobility aiding device, such as a walker, a wheelchair, a transport chair, a shower seat or a rollator, for use in providing support to injured or ailing persons during activity or movement. According to the present invention a solid two-piece seating platform is provided with a structural support for distributing the weight of the user to the frame. Furthermore, the two pieces of the seating platform are inter-hinged, enabling the entire device to fold up into a storage position. A lock is provided for maintaining the structural support in place, and a handle is provided for facilitating folding the device into the storage position.

U.S. Patent Application Publication Number 2008/0129016, by Wills, discloses a mobility device that includes at least a first front leg and at least a first rear leg connected to the first front leg connected to the first front leg. The first rear leg includes an upper member having a first end a second end and a lower member having a first end and a second end. The first end of the upper member is pivotally connected to the first end of the lower member, and the lower member is preferably pivotal between an extended use position and a folded storage position.

Additionally, patents that relate to folding walkers include the following:

| Patent No. | Issue Date | Inventor(s) |
|---|---|---|
| 3,840,034 | Oct. 08, 1972 | Smith |
| 4,298,016 | Nov. 3, 1981 | Garelick |
| 4,461,471 | Jul. 24, 1984 | Brastow |
| 4,640,301 | Feb. 3, 1987 | Battiston et al. |
| 5,188,139 | Feb. 23, 1993 | Garelick |
| 5,476,432 | Dec. 19, 1995 | Dickens |
| 5,529,425 | Jun. 25, 1996 | Spies et al. |
| 6,481,730 | Nov. 19, 2002 | Sung |

-continued

| Patent No. | Issue Date | Inventor(s) |
|---|---|---|
| 6,837,503 | Jan. 4, 2005 | Chen et al. |
| 8,480,100 | Jul. 9, 2013 | Staggs |
| 8,936,256 | Jan. 20, 2015 | Liu |
| 9,662,264 | May 30, 2017 | Jacobs |
| 9,861,549 | Jan. 9, 2018 | Karlovich |
| 10,434,031 | Oct. 8, 2019 | Pan et al. |
| 10,555,866 | Feb. 11, 2020 | Pan et al. |

A need is still felt for device or component that securely holds the legs of a walker in a folded state when the walker has been folded, preferably at a location proximate the lower extremities of the legs of the walker.

SUMMARY OF THE INVENTION

Disclosed herein are various example embodiments of the present general inventive concept.

Thus, in some example embodiments of the present general inventive concept, a rollator walker assembly with locking mechanism includes a walker including a pair of front legs and a pair of back legs, each said front leg and back leg having an upper end and a lower end, the walker being switchable between an unfolded state and a folded state; and a locking mechanism adapted to secure a front leg and a back leg when the walker is in the folded state, wherein said locking mechanism is connected to said front leg at a position closer to the front leg's lower end than the front leg's upper end, and wherein said locking mechanism is connected to said back leg at a position closer to the back leg's lower end than the back leg's upper end.

In some embodiments, the locking mechanism includes plastic components.

In some embodiments, the locking mechanism includes aluminum components.

In some embodiments, the locking mechanism includes components fabricated from stainless steel.

In some embodiments, the rollator walker includes a pair of locking mechanisms, one for each pair of front and back legs.

In some example embodiments of the present general inventive concept, a rollator walker assembly with locking mechanism includes a walker frame including a first front leg and a second front leg, the first front leg and the second front leg being spaced apart and substantially parallel to each other, a first back leg and a second back leg, the first back leg and the second back leg being spaced apart and substantially parallel to each other, said first front leg and said second front leg each having an upper end and a lower end, said first back leg intersecting said first front leg at a position closer to the upper end of said first front leg than to the lower end of said first front leg, and said second back leg intersecting said second front leg at a position closer to the upper end of said second front leg than to the lower end of said second front leg, said first front leg connected to said first back leg by a first folding bracket, and said second front leg connected to said second back leg by a second folding bracket, the walker frame being switchable between an unfolded state and a folded state; and a locking mechanism adapted to secure a front leg and a back leg when the walker is in the folded position, whereby at least two legs of the walker are locked together when the walker frame is in a folded state.

In some embodiments, said locking mechanism is connected to said front leg at a position closer to the front leg's lower end than the front leg's upper end, and wherein said locking mechanism is connected to said back leg at a position closer to the back leg's lower end than the back leg's upper end.

In some embodiments, said locking mechanism includes a first member attached to said front leg and a second member attached to said back leg, the first member and the second member positioned and configured to come together in a releasable conjunction when said walker frame is in the folded state.

In some embodiments, at least one of said first member and said second member includes a hook.

In some embodiments, said rollator walker assembly includes a first locking mechanism adapted to secure said first front leg and said first back leg and a second locking mechanism adapted to secure said second front leg and said second back leg.

In some embodiments, said locking mechanism including a central connecting bar and two terminal C-snap connectors at opposing ends of said central connecting bar, said two terminal C-snap connectors including a front C-snap and a back C-snap, the front C-snap being adapted to connect to a front leg of the walker, and the back C-snap being adapted to connect to a back leg of the walker.

In some embodiments, a first latching member and a second latching member fit together in a frictional fit. In some example embodiments, a first latching member includes a hook, which interacts with the second latching member.

In some example embodiments of the present general inventive concept, a detachable locking mechanism for a rollator walker includes a central connecting bar and two terminal C-snap connectors at opposing ends of said central connecting bar, said two terminal C-snap connectors including a front C-snap and a back C-snap; the front C-snap being adapted to connect to a front leg of the walker, and the back C-snap being adapted to connect to a back leg of the walker, whereby the legs of the walker are locked together when the walker is in a folded state.

In some embodiments, the locking mechanism includes components fabricated from plastic or aluminum.

In some embodiments, the C-snaps are fabricated from plastic.

In some embodiments, the C-snaps are fabricated from plastic.

Some embodiments further comprise a handle attached to the central connecting bar.

In some embodiments, a detachable locking mechanism includes a central connecting bar and two terminal C-snap connectors, a front C-snap and a back C-snap. The front C-snap is adapted to connect to a front leg of the walker, and the back C-snap is adapted to connect to a back leg, thereby locking the legs together when the walker is in the folded state. In various example embodiments, the locking mechanism includes components fabricated from various materials (e.g., plastic, aluminum, etc.), and in particular the C-snaps may be fabricated from various materials, including but not limited to plastic.

In some embodiments, a detachable locking mechanism includes a handle.

BRIEF DESCRIPTION OF THE DRAWING FIGURES

The above-mentioned and additional features of the invention will become more clearly understood from the following detailed description of the invention read together with the drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 1:
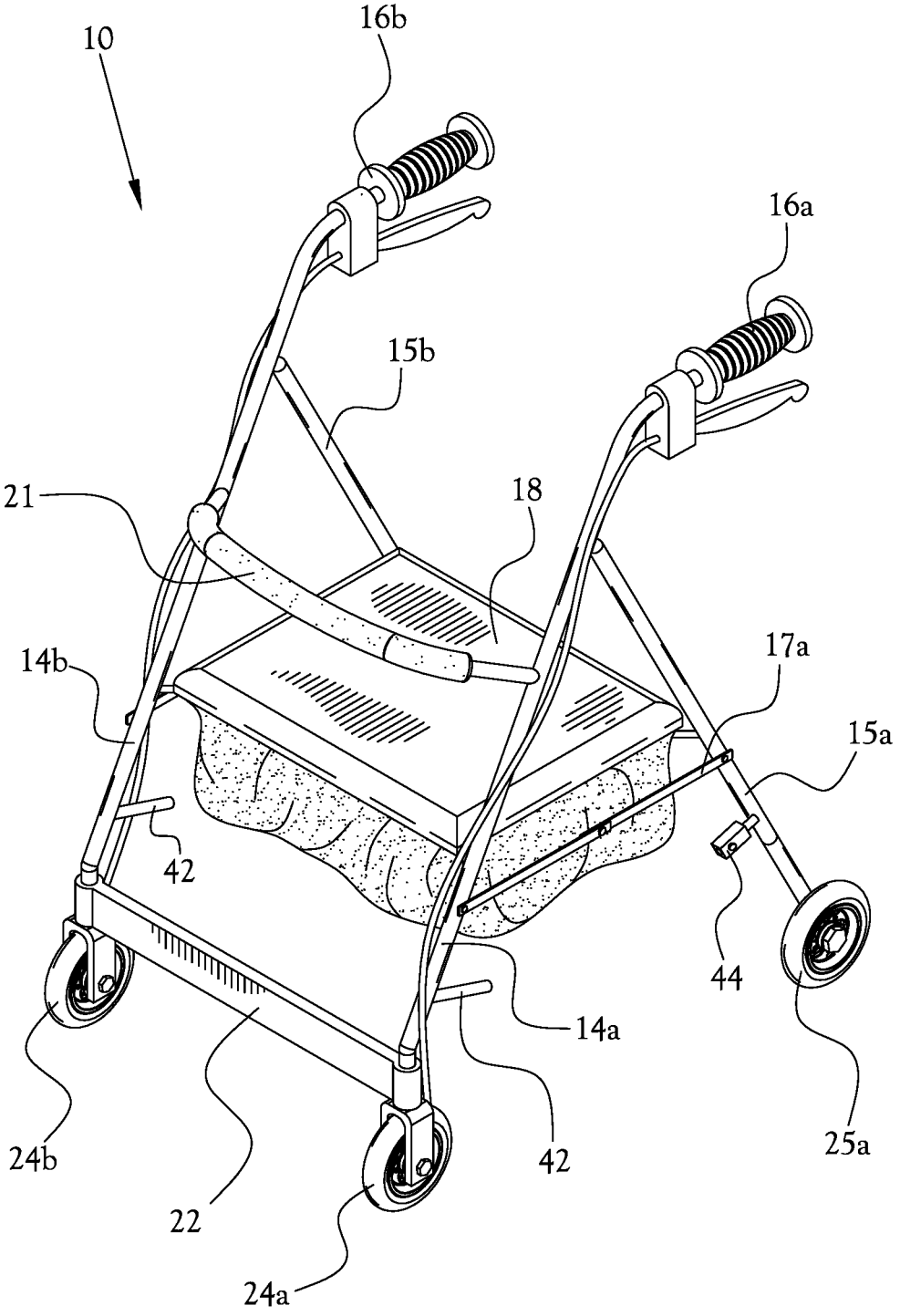
FIG. 1 is a perspective view of a rollator walker with a locking mechanism according to one example embodiment of the present general inventive concept.
Figure 2B:
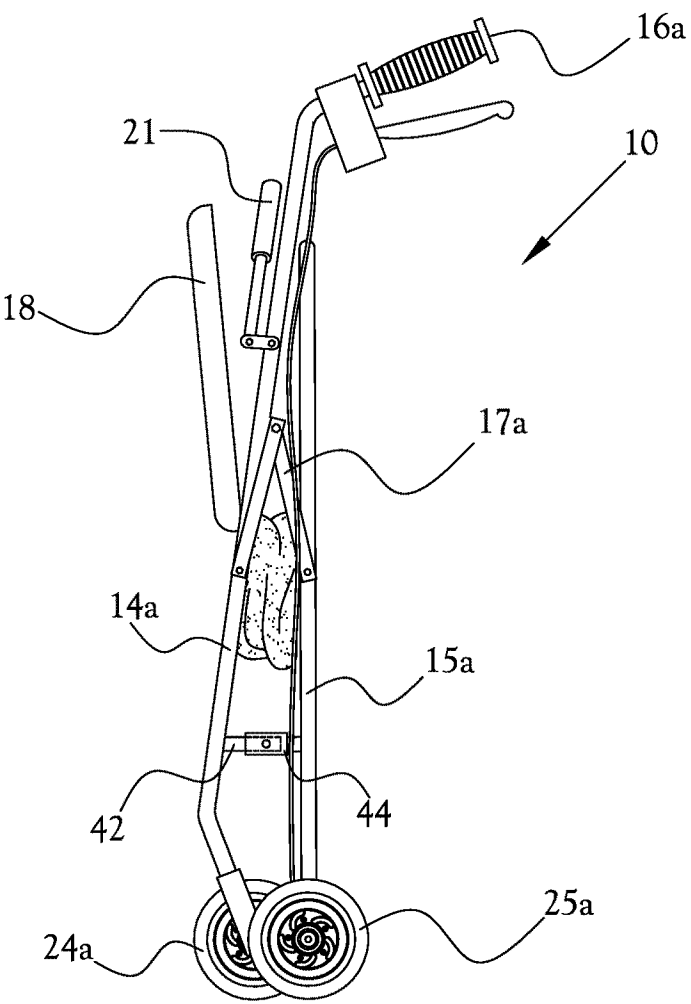
FIG. 2B is a side view of the example embodiment shown in FIG. 2A, showing the walker in a folded state.
Figure 2A:
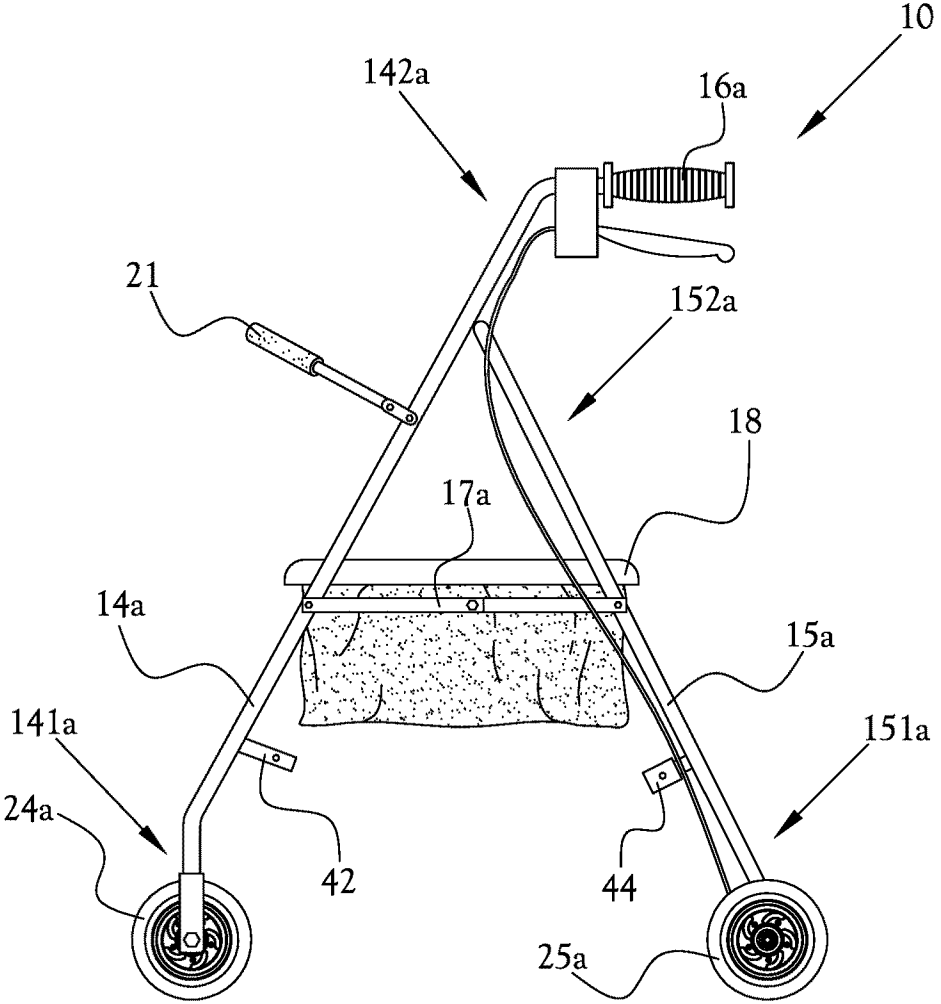
FIG. 2A is a side view of the example embodiment shown in FIG. 1, showing the walker in an unfolded state.

Turning to the Figures, FIG. 1 shows a perspective view of a rollator walker with a locking mechanism according to one example embodiment of the present general inventive concept. According to the example embodiment illustrated in FIG. 1, a rollator walker 10 includes two front legs 14*a* and 14*b*, as well as two back legs 15*a* and 15*b*. In the illustrated example embodiment, each leg also includes a wheel; three of those wheels 24*a*, 24*b*, 25*a* are shown in FIG. 1. In the illustrated example embodiment, the rollator walker 10 also includes handles 16*a* and 16*b*, a seat 18, and at least two cross-braces 21, 22. As shown in FIGS. 2A and 2B, the illustrated rollator walker 10 is switchable between an unfolded state (shown in FIG. 2A) and a folded state (shown in FIG. 2B). As may be seen in FIG. 1 and in FIG. 2A, on either side of the rollator walker 10, a folding bracket connects the front leg and back leg; in FIG. 2A, a folding bracket 17*a* connects front leg 14*a* and back leg 15*a*. When the rollator walker 10 is in its unfolded state, the folding bracket 17*a* is generally substantially straight, i.e., unfolded. When the rollator walker 10 is in its unfolded state, the folding bracket 17*a* is also folded, as shown in FIG. 2B.

As illustrated in FIG. 2A, in the illustrated example embodiment, each leg has an upper end and a lower end. In FIG. 2A, for example, the front leg 14*a* includes a lower end, designated generally 141*a*, and an upper end, designated generally 142*a*. Likewise, the back leg 15*a* includes a lower end, designated generally 151*a*, and an upper end, designated generally 152*a*. The handles 16*a* and 16*b* are positioned proximate the upper ends of the legs, and the wheels are positioned proximate the lower ends of their respective legs. Generally, the folding bracket is positioned approximately or substantially mid-way between the upper ends and lower ends of the legs.

In the example embodiment illustrated in FIGS. 1, 2A, and 2B, the the rollator walker 10 includes a locking mechanism encompassing a first latching member 42 and a second latching member 44. The first latching member 42 is positioned on the front leg 14*a*, and second latching member 44 is positioned on the back leg 15*a*. The first latching member 42 and second latching member 44 are positioned on their respective legs such that when the legs are brought together in the walker's folded state, the first latching member 42 and second latching member 44 connect, as shown in FIG. 2B, thereby locking the rollator walker 10 in the folded state until such time as the connection between first latching member 42 and second latching member 44 is disrupted by a user in order to switch the rollator walker 10 to its unfolded state.

In some embodiments, the rollator walker 10 includes a pair of locking mechanisms, one for each pair of front and back legs.

In contrast to various prior art devices, in various example embodiments of the present general inventive concept, the locking mechanism is positioned on the legs of the walker closer to the lower ends of the legs than to the upper ends of the legs.

Figure 3B:
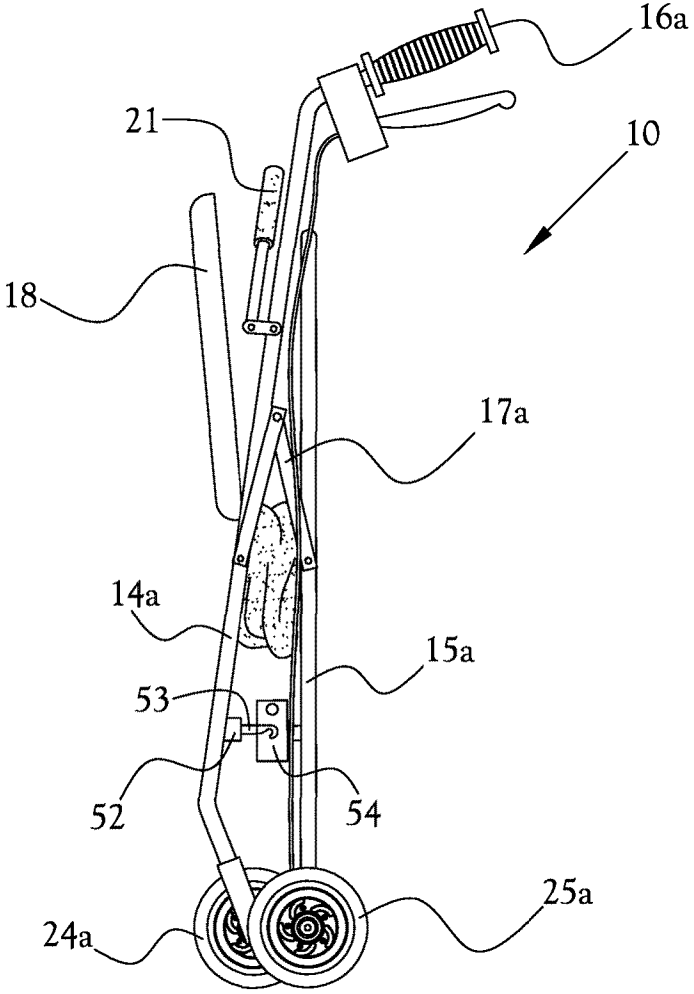
FIG. 3B is a side view of the example embodiment shown in FIG. 3A, showing the walker in a folded state.
Figure 3A:
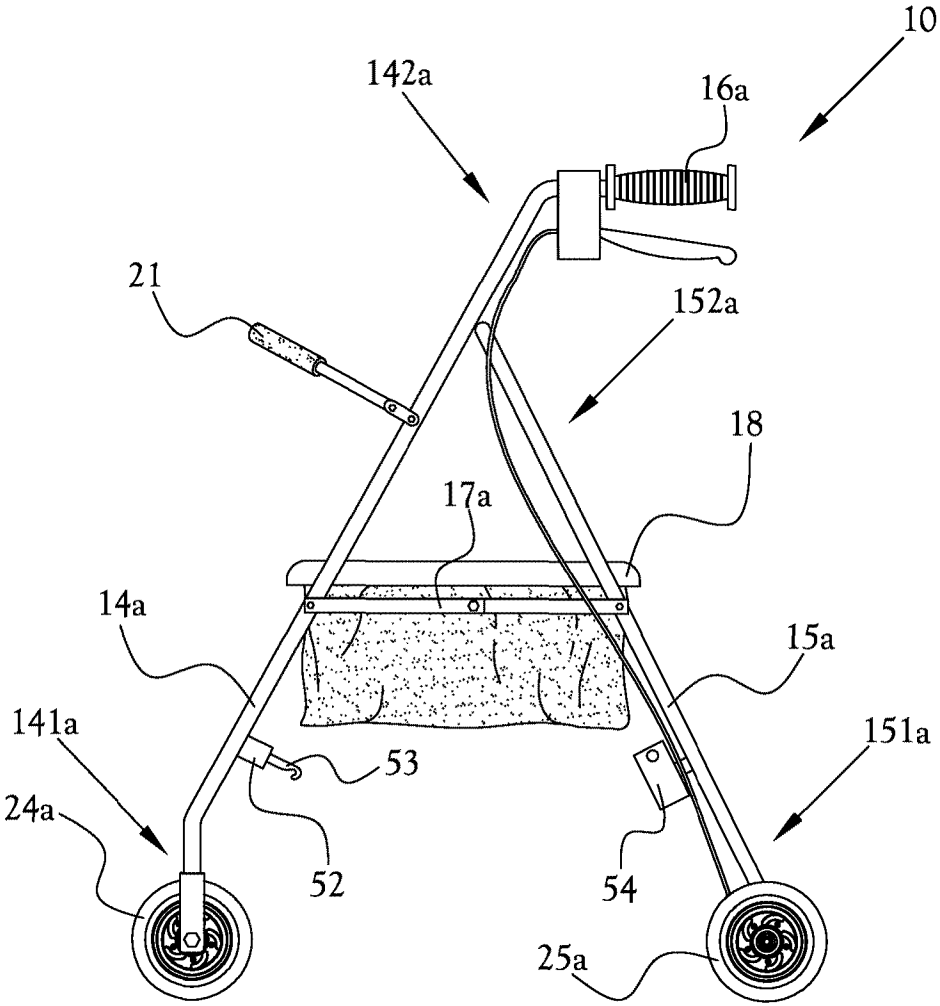
FIG. 3A is a side view of another example embodiment of the present general inventive concept, showing the walker in an unfolded state.

Various types of locking mechanisms and latching devices are contemplated by and encompassed by the present general inventive concept. In some embodiments, the first latching member and second latching member fit together in a frictional fit. In some example embodiments, such as the one shown in FIGS. 3A and 3B, a first latching member 52 includes a hook 53, which interacts with the second latching member 54, as shown in FIG. 3B.

According to various example embodiments of the present general inventive concept, locking mechanisms and latching devices for rollator walkers may be fabricated from various materials. In some embodiments, the locking mechanism includes plastic components. In some embodiments, the locking mechanism includes aluminum components. In some embodiments, the locking mechanism includes components fabricated from stainless steel or some similar metal and/or alloy. Additional possibilities and embodiments will be readily apparent to those skilled in the art, and these additional possibilities and embodiments are also contemplated by and encompassed by the present general inventive concept.

Figure 4B:
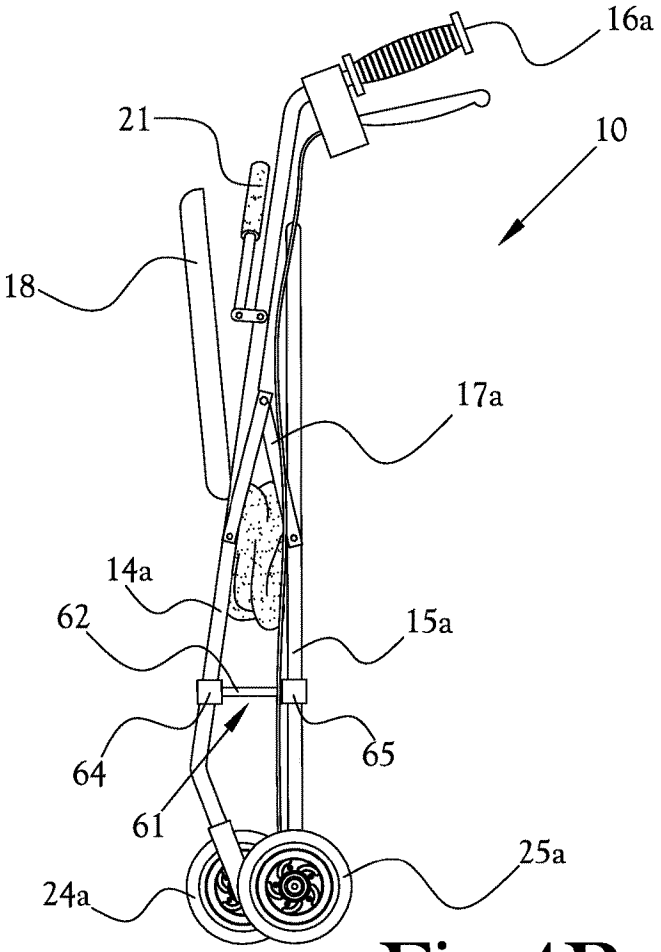
FIG. 4B is a side view of the example embodiment shown in FIG. 4A, showing the walker in a folded state.
Figure 4:
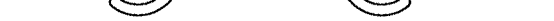
FIG. 4 is view of a locking mechanism according to one example embodiment of the present general inventive concept.
Figure 4A:
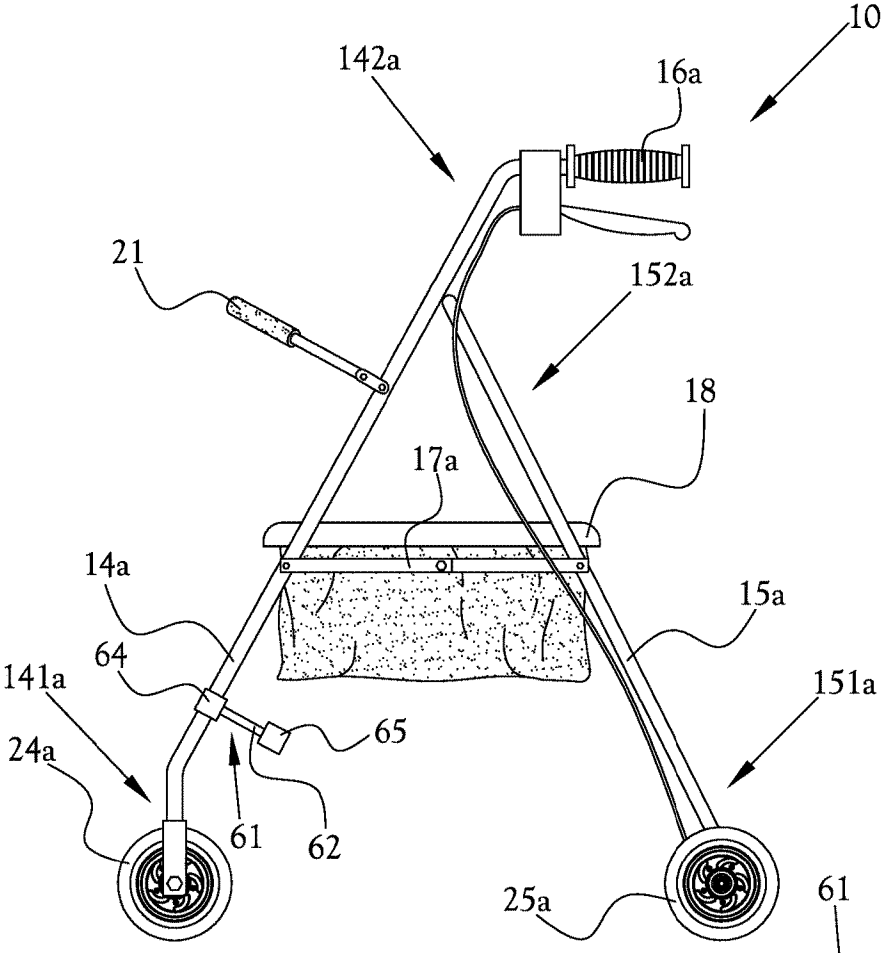
FIG. 4A is a side view of a rollator walker with the locking mechanism shown in FIG. 4, showing the walker in an unfolded state.

FIG. 4 shows a locking mechanism 61 according to a further example embodiment of the present general inventive concept. As shown in FIG. 4, the locking mechanism 61 includes a central connecting bar 62 and two terminal C-snap connectors, a front C-snap 64 and a back C-snap 65. The front C-snap 64 is adapted to connect to the front leg 14*a*, as shown in FIG. 4A, and the back C-snap 65 is adapted to connect to the back leg 15*a*, thereby locking the legs together when the rollator walker is in the folded state, as shown in FIG. 4B. In various example embodiments, the locking mechanism 61 includes components fabricated from various materials (e.g., plastic, aluminum, etc.), and in particular the C-snaps may be fabricated from various materials, including but not limited to plastic. In some embodiments, the detachable locking mechanism 61 includes a handle.

Various modifications to the mechanisms and devices heretofore described may be made without departing from the spirit and scope of the present general inventive concept.

Various example embodiments of the present general inventive concept provide a rollator walker assembly with locking mechanism comprises a walker including a pair of front legs and a pair of back legs, each said front leg and back leg having an upper end and a lower end, the walker being switchable between an unfolded position and a folded position; and a locking mechanism adapted to secure a front leg and a back leg when the walker is in the folded position, wherein said locking mechanism is connected to said front leg at a position closer to the front leg's lower end than the front leg's upper end, and wherein said locking mechanism is connected to said back leg at a position closer to the back leg's lower end than the back leg's upper end.

According to certain example embodiments of the present general inventive concept, a rollator walker assembly with locking mechanism includes a walker frame including a first front leg and a second front leg, the first front leg and the second front leg being spaced apart and substantially parallel to each other, a first back leg and a second back leg, the first back leg and the second back leg being spaced apart and substantially parallel to each other, said first front leg and said second front leg each having an upper end and a lower end, said first back leg intersecting said first front leg at a position closer to the upper end of said first front leg than to the lower end of said first front leg, and said second back leg intersecting said second front leg at a position closer to the upper end of said second front leg than to the lower end of said second front leg, said first front leg connected to said first back leg by a first folding bracket, and said second front leg connected to said second back leg by a second folding bracket, the walker frame being switchable between an unfolded state and a folded state; and a locking mechanism adapted to secure a front leg and a back leg when the walker is in the folded position, whereby at least two legs of the walker are locked together when the walker frame is in a folded state.

In some embodiments, said locking mechanism is connected to said front leg at a position closer to the front leg's lower end than the front leg's upper end, and wherein said locking mechanism is connected to said back leg at a position closer to the back leg's lower end than the back leg's upper end.

In some embodiments, said locking mechanism includes a first member attached to said front leg and a second member attached to said back leg, the first member and the second member positioned and configured to come together in a releasable conjunction when said walker frame is in the folded state.

In some embodiments, at least one of said first member and said second member includes a hook.

In some embodiments, said rollator walker assembly includes a first locking mechanism adapted to secure said first front leg and said first back leg and a second locking mechanism adapted to secure said second front leg and said second back leg.

In some embodiments, said locking mechanism including a central connecting bar and two terminal C-snap connectors at opposing ends of said central connecting bar, said two terminal C-snap connectors including a front C-snap and a back C-snap, the front C-snap being adapted to connect to a front leg of the walker, and the back C-snap being adapted to connect to a back leg of the walker.

In some embodiments, a first latching member and a second latching member fit together in a frictional fit. In some example embodiments, a first latching member includes a hook, which interacts with the second latching member.

In some example embodiments of the present general inventive concept, a detachable locking mechanism for a rollator walker includes a central connecting bar and two terminal C-snap connectors at opposing ends of said central connecting bar, said two terminal C-snap connectors including a front C-snap and a back C-snap; the front C-snap being adapted to connect to a front leg of the walker, and the back C-snap being adapted to connect to a back leg of the walker, whereby the legs of the walker are locked together when the walker is in a folded state. In some embodiments, the locking mechanism includes components fabricated from plastic or aluminum. In some embodiments, the C-snaps are fabricated from plastic. In some embodiments, the C-snaps are fabricated from plastic. Some embodiments further comprise a handle attached to the central connecting bar.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A rollator walker assembly with locking mechanism, comprising:

a walker frame including a first front leg and a second front leg, the first front leg and the second front leg being spaced apart and substantially parallel to each other, a first back leg and a second back leg, the first back leg and the second back leg being spaced apart and substantially parallel to each other, said first front leg and said second front leg each having an upper end and a lower end, said first back leg intersecting said first front leg at a position closer to the upper end of said first front leg than to the lower end of said first front leg, and said second back leg intersecting said second front leg at a position closer to the upper end of said second front leg than to the lower end of said second front leg, said first front leg connected to said first back leg by a first folding bracket, and said second front leg connected to said second back leg by a second folding bracket, the walker frame being switchable between an unfolded state and a folded state; and a locking mechanism adapted to secure a front leg and a back leg when the walker is in the folded position, whereby at least two legs of the walker are locked together when the walker frame is in a folded state, wherein said locking mechanism includes a first member attached to said front leg and a second member attached to said back leg, the first member and the second member positioned and configured to come together in a releasable conjunction when said walker frame is in the folded state, and wherein at least one of said first member and said second member includes a hook.

2. A rollator walker assembly with locking mechanism, comprising:

a walker frame including a first front leg and a second front leg, the first front leg and the second front leg being spaced apart and substantially parallel to each other, a first back leg and a second back leg, the first back leg and the second back leg being spaced apart and substantially parallel to each other, said first front leg and said second front leg each having an upper end and a lower end, said first back leg intersecting said first front leg at a position closer to the upper end of said first front leg than to the lower end of said first front leg, and said second back leg intersecting said second front leg at a position closer to the upper end of said second front leg than to the lower end of said second front leg, said first front leg connected to said first back leg by a first folding bracket, and said second front leg connected to said second back leg by a second folding bracket, the walker frame being switchable between an unfolded state and a folded state; and a locking mechanism adapted to secure a front leg and a back leg when the walker is in the folded position, whereby at least two legs of the walker are locked together when the walker frame is in a folded state, wherein said locking mechanism including a central connecting bar and two terminal C-snap connectors at opposing ends of said central connecting bar, said two terminal C-snap connectors including a front C-snap and a back C-snap, the front C-snap being adapted to connect to a front leg of the walker, and the back C-snap being adapted to connect to a back leg of the walker.

* * * * *